US005698310A

United States Patent [19]

Nakamura et al.

[11] Patent Number: 5,698,310

[45] Date of Patent: Dec. 16, 1997

[54] METHOD FOR FILM FORMATION AND PRODUCT THEREOF

[75] Inventors: Shigeru Nakamura; Yutaka Mizutani; Terukazu Shibata; Toru Ozaki, all of Nishikamo-gun, Japan

[73] Assignee: Kansai Paint Co., Ltd., Amagasaki, Japan

[21] Appl. No.: 589,007

[22] Filed: Jan. 19, 1996

[30] Foreign Application Priority Data

Jan. 20, 1995 [JP] Japan ..... 7-024608

[51] Int. Cl.[6] ..... C23C 28/00

[52] U.S. Cl. ..... 428/328; 204/488; 204/501; 427/388.2; 427/407.1; 427/409

[58] Field of Search ..... 204/488, 489, 204/500, 501; 205/50, 198, 199; 427/388.2, 407.1, 409; 428/328

[56] References Cited

U.S. PATENT DOCUMENTS 5,326,596 7/1994 Kaseri et al. ..... 427/39
5,389,406 2/1995 Doebler ..... 427/407.1

FOREIGN PATENT DOCUMENTS

0402181A1 12/1990 European Pat. Off. .

*Primary Examiner*—Kathryn L. Gorgos
*Assistant Examiner*—William T. Leader
*Attorney, Agent, or Firm*—Wenderoth, Lind & Ponack

[57] ABSTRACT

The present invention provides a method for film formation, which comprises applying onto a substrate an electrocoating (A) and an intermediate coating (B) in this order, heat-curing the formed films of the coatings (A) and (B), applying thereon a liquid light color coating (C), the liquid light color coating (C) forming a color film having an L value of 30–95 in the Lab color system, which comprises 100 parts by weight of a thermosetting resin composition, 0.1–30 parts by weight of a fine aluminum powder having an average particle diameter of less than 10μ and 1–200 parts by weight of a titanium oxide pigment and which shows a film hiding power of 25μ or less and a film elongation ratio of 10–50% at 20° C., a liquid metallic coating (D) which comprises 100 parts by weight of a thermosetting resin composition and 0.1–20 parts by weight of a metallic pigment having an average particle diameter of 3μ or more and which shows a film hiding power of 50μ or more and a film elongation ratio of 10% or less at 20° C., and a clear coating (E) in this order on a wet-on-wet basis, and heating the formed films of the coatings (C), (D) and (E) to crosslink and cure the three films simultaneously. According to the method, part of the heat-curing steps employed in multilayer film formation can be eliminated and a multilayer film of smaller thickness and improved properties (e.g. improved surface smoothness and chipping resistance) can be obtained.

25 Claims, No Drawings

METHOD FOR FILM FORMATION AND PRODUCT THEREOF

The present invention relates to a method for formation of a multilayer film comprising an electrocoating film, an intermediate coating film, a color coating film, a metallic coating film and a clear coating film and having a glittering appearance. More particularly, the present invention relates to a method for formation of a multilayer film, in which method part of the heat-curing steps employed in multilayer film formation can be eliminated and which method can give a multilayer film of smaller thickness and improved properties (e.g. improved surface smoothness and chipping resistance).

It is known to form a multilayer film by applying, on a substrate, an electrocoating and an intermediate coating, heat-curing the formed films, applying thereon a color base coating, heat-curing the formed film, applying thereon a metallic coating and a clear coating on a wet-on wet basis, and heat-curing the formed films. In the thus-formed multilayer film, a light passes through the clear coating film and the metallic coating film, and the hue of the color base coating film provides color decorativeness together with the metallic effect of the metallic coating film.

In the above known method for formation of multilayer film, however, it has been necessary to (1) form the color base coating film in a thickness (as cured) of generally 30μ or more in order to hide the sublayer film and (2) heat-cure the color base coating film before the next coating (the metallic coating) is applied, to prevent the intermixing between the color base coating film and the metallic coating; moreover, the resulting multilayer film is not sufficient in chipping resistance, surface smoothness, etc.; thus, improvements have been desired.

The present inventors made a study in order to solve the above-mentioned problems of the prior art. As a result, it was found out that by using, in the formation of multilayer film, a combination of a fine aluminum powder and a titanium oxide pigment in the color base coating, (1) the resulting multilayer film has an improved hiding power and can have a smaller thickness, (2) the intermixing between the color base coating film and the metallic coating film can be prevented, and (3) the step of heat-curing the color base coating film can be eliminated. It was also found out that by formulating the color base coating and the metallic coating so as to each show a particular film elongation ratio, the resulting multilayer film can have improved properties (e.g. improved chipping resistance and surface smoothness). The present invention has been completed based on the above findings.

The present invention provides a method for film formation, which comprises applying onto a substrate an electrocoating (A) and an intermediate coating (B) in this order, heat-curing the formed films of the coatings (A) and (B), applying thereon a liquid light color coating (C) which comprises 100 parts by weight of a thermosetting resin composition, 0.1–30 parts by weight of a fine aluminum powder having an average particle diameter of less than 10μ and 1–200 parts by weight of a titanium oxide pigment and which shows a film hiding power of 25μ or less and a film elongation ratio of 10–50% at 20° C., a liquid metallic coating (D) which comprises 100 parts by weight of a thermosetting resin composition and 0.1–20 parts by weight of a metallic pigment having an average particle diameter of 3μ or more and which shows a film hiding power of 50μ or more and a film elongation ratio of 10% or less at 20° C., and a clear coating (E) in this order on a wet-on-wet basis, and heating the formed films of the coatings (C), (D) and (E) to crosslink and cure the three films simultaneously.

The method for film formation according to the present invention is hereinafter described in detail.

Electrocoating (A)

Any of a cationic electrocoating and an anionic electrocoating can be used. However, a cationic electrocoating is generally preferred in view of the corrosion resistance.

The cationic electrocoating can be a per se known cationic electrocoating obtained by adding, as necessary, a crosslinking agent, a pigment and other additives to an aqueous solution or dispersion of a salt of a cationizable group-containing polymeric substance. The cationizable group-containing polymeric substance includes, for example, those substances obtained by modifying a base resin (e.g. an acrylic resin or an epoxy resin) with an amino compound or the like to introduce a cationizable group into the base resin. By neutralizing the cationizable group-containing polymeric substance with an acid such as organic acid, inorganic acid or the like, an aqueous solution or dispersion can be obtained, As the crosslinking agent, a blocked polyisocyanate compound, an alicyclic epoxy resin or the like can be preferably used.

Into a bath of the cationic electrocoating is immersed a metallic substrate (a material to be coated) (e.g. an automobile body) (the substrate acts as a cathode), and an electric current is passed between the cathode and an anode under ordinary conditions to apply the electrocoating onto the substrate. The thickness of the resulting electrocoating film can be determined as desired depending upon the application purpose but preferably is generally 10–30μ, particularly 15–25μ as cured. The electrocoating film can be crosslinked and cured by heating generally at a temperature of about 140°–200° C. for about 10–40 minutes. In the present invention, while the electrocoating film is in an uncrosslinked state, an intermediate coating (B) can be applied thereon; however, it is generally preferable that the intermediate coating (B) is applied after the electrocoating film has been crosslinked and cured.

Intermediate Coating (B)

This is a coating applied on the film of the electrocoating (A). It can be a per se known liquid coating composition comprising a thermosetting resin composition and a solvent as main components and, as necessary, a coloring pigment, an extender pigment and other additives for coating. The intermediate coating (B) serves to endow the finally obtained multilayer film with improved smoothness, distinctness of image gloss, luster, etc.

Specific examples of the thermosetting resin composition used in the intermediate coating (B) are those compositions obtaining by adding, to a base resin such as acrylic resin, polyester resin, alkyd resin or the like, having a crosslinkable functional group such as hydroxyl group or the like, a crosslinking agent such as melamine resin, urea resin, blocked or unblocked polyisocyanate compound or the like. The solvent includes an organic solvent and/or water.

The intermediate coating (B) can be applied on the crosslinked and cured film or uncured film of the electrocoating (A) by electrostatic coating, air spraying, airless spraying or the like. The preferable thickness of the film of the intermediate coating (B) generally 10–50μ, particularly 20–40μ as cured. The film can be crosslinked and cured by heating generally at a temperature of 100°–170° C. for about 10–40 minutes. In the present invention, after the film of the intermediate coating (B) has been crosslinked and cured, a light color coating (C) is applied.

Light Color Coating (C)

The light color coating (C) is applied on the crosslinked and cured film of the intermediate coating (B) and is a liquid coating composition which comprises 100 parts by weight (as solid content, the same applies hereinafter) of a thermosetting resin composition, 0.1–30 parts by weight of a fine aluminum powder having an average particle diameter of less than 10μ and 1–200 parts by weight of a titanium oxide pigment and which shows, in its cured film state, a film hiding power of 25μ or less and a film elongation ratio of 10–50% at 20° C.

The coating (C) is characterized by comprising both of a fine aluminum powder and a titanium oxide pigment. As a result, the film of the coating (C) has an excellent hiding power and can sufficiently hide the sublayer (the intermediate coating film) in a thin thickness (as cured) of 25μ or less and, depending upon the contents of the aluminum powder and the titanium oxide pigment, 5–20μ, particularly 6–15μ; moreover, there occurs substantially no intermixing between the uncured film of the coating (C) and a metallic coating (D) applied thereon on a wet-on-wet basis.

The thermosetting resin composition used in the light color coating (C) is preferably a composition comprising a base resin such as acrylic resin, polyester resin, alkyd resin or the like, having a crosslinkable functional group such as hydroxyl group or the like and a crosslinking agent such as amino resin (e.g. melamine resin or urea resin) or the like.

Herein, "film elongation ratio" referred to for the light color coating (C) is a value obtained when the measurement was made for a film formed by heat-curing the above-mentioned thermosetting resin composition alone. The film elongation ratio is specifically obtained by dissolving or dispersing the thermosetting resin composition in an appropriate solvent, coating the solution or dispersion on a tinplate sheet in a film thickness of 15μ as cured, heat-curing the resulting film at 140° C. for 30 minutes, separating the cured film by a mercury amalgamation method, cutting the separated film into a rectangular test piece of 20 mm (length)×5 mm (width), and subjecting the test piece to a tensile test at a tensile speed of 20 mm/min at 20° C. using a universal tensile strength tester with a controlled temperature bath (Autograph S-D, a product of Shimadzu Corporation) until the test piece is ruptured.

In the present invention, the light color coating (C) has a film elongation ratio of 10–50%, preferably 15–40%, more preferably 20–35% at 20° C. When the film elongation ratio deviates from this range, the resulting multilayer film generally has reduced chipping resistance, smoothness, impact resistance, etc. The film elongation ratio can be easily controlled by changing the kinds, proportions, etc. of the basic resin and crosslinking agent used in the coating (C).

The fine aluminum powder used in the light color coating (C) has an average particle diameter of less than 10μ, preferably 3–7μ. When the average particle diameter is more than 10μ, the resulting film has a reduced hiding powder. Herein, "average particle diameter" is a median diameter obtain ed by a laser diffraction scattering method using LA-500 (trade name) produced by Horiba, Ltd. (the same applies also hereinafter).

The fine aluminum powder is preferably a fine powder of metallic aluminum, and the particle surfaces may be treated with a silane coupling agent or the like.

Meanwhile, the titanium oxide pigment can be a per se known titanium oxide pigment. It preferably has an average particle diameter of generally 5μ or less, particularly 2μ or less. The surface of the titanium oxide pigment may be treated with alumina, silica or the like.

The amounts of the fine aluminum powder and titanium oxide pigment used in the coating (C) can be 0.1–30 parts by weight, preferably 0.5–20 parts by weight, more preferably 1–7 parts by weight (the fine aluminum powder) and 1–200 parts by weight, preferably 50–150 parts by weight, more preferably 80–120 parts by weight (the titanium oxide pigment) per 100 parts by weight of the thermosetting resin composition. Further, the fine aluminum powder can be used in an amount of 1–15 parts by weight, preferably 1–10 parts by weight, more preferably 2–7 parts by weight per 100 parts by weight of the titanium oxide pigment.

In the light color coating (C), it is requisite to use the fine aluminum powder and the titanium oxide pigment in combination. The two components are used so that the resulting light color coating (C) shows a cured film hiding power of 25μ or less.

In the present specification, "hiding power" refers to a minimum film thickness in which the color of the sublayer cannot be recognized with naked eyes. It is specifically a minimum film thickness in which when a film is formed on a black-and-white-checkered substrate and visual observation is made from above the film, the black and white color of the substrate is unrecognizable. In the present invention, by using both the fine aluminum powder and the titanium oxide pigment in the coating (C), it has become possible to form the film of coating (C) in a small thickness, i.e. a film hiding powder of 25μ or less.

The light color coating (C) can be prepared by dispersing the above-mentioned components in a solvent, for example, an organic solvent and/or water.

The film formed with the light color coating (C) has a light color. The light color is appropriately 30–95, particularly 50–80 in terms of L value in Lab color system. As long as a film of such a light color is formed, the coating (C) can further comprise, as necessary, a color pigment and a metallic pigment other than the fine aluminum powder and the titanium oxide pigment, an extender pigment, a precipitation inhibitor, etc. The light color coating (C) generally shows no or substantially no glittering appearance.

In the present invention, the light color coating (C) is preferably applied on the crosslinked and cured film of the intermediate coating (B) in a film thickness of 3–25μ, particularly 5–20μ, more particularly 6–15μ as cured by electrostatic coating, air spraying, airless spraying or the like. In the present invention, it is preferable that the film of the coating (C) is dried at room temperature or at an elevated temperature (100° C. or less is preferable) without crosslinking and curing it and then a metallic coating (D) is applied thereon.

Metallic Coating (D)

The metallic coating (D) is applied on the uncrosslinked film of the light color coating (C) and is a liquid coating composition which comprises 100 parts by weight of a thermosetting resin composition and 0.1–20 parts by weight of a metallic pigment having an average particle diameter of 10μ or more and which shows, in its crosslinked and cured film state, a film hiding power of 50μ or more and a film elongation ratio of 10% or less at 20° C.

The film of the metallic coating (D) contains a metallic pigment and therefore gives a glittering appearance and/or a light iridescent pattern. Further, the film has a small hiding power and therefore the hue of the film of the light color coating (C) can be seen therethrough.

The thermosetting resin composition is preferably a composition comprising a base resin such as acrylic resin, polyester resin, alkyd resin or the like, having a crosslinkable functional group (e.g. hydroxyl group) and a crosslinking agent such as amino resin (e.g. melamine resin or urea resin) or the like.

The film elongation ratio of the metallic coating (D) is 10% or less, preferably 8% or less, more preferably 7% or less at 20° C. The "film elongation ratio" is a value obtained when the heat-cured film of the thermosetting resin composition alone has been tested in the same manner as mentioned with respect to the light color coating (C). That is, the film elongation ratio is obtained by coating the thermosetting resin composition on a tinplate sheet in a film thickness of 15μ as cured, heat-curing the resulting film at 140° C. for 30 minutes, separating the cured film by a mercury amalgamation method, cutting the separated film into a rectangular test piece of 20 mm (length)×5 mm (width), and subjecting the test piece to a tensile test at a tensile speed of 20 mm/min at 20° C. using a universal tensile tester with a controlled temperature bath (Autograph S-D, a product of Shimadzu Corporation) until the test piece is ruptured. When the elongation ratio of the film of the metallic coating (D) is larger than 10% at 20° C., the resulting multilayer film generally shows reduced finish appearance, luster, resistance to swelling by solvents, etc.

The metallic pigment used in the metallic coating (D) is preferably a pigment of scaly particles having a light iridescent action or a glittering appearance. It includes, for example, aluminum, mica, mica coated with a metal oxide, mica-like iron oxide, and mica-like iron oxide coated with a metal oxide. The average particle diameter of the metallic pigment can be generally 10μ or more, preferably 10–50μ, more preferably 15–40μ. The amount of the metallic pigment used is 0.1–20 parts by weight, preferably 2–15 parts by weight, more preferably 3–10 parts by weight per 100 parts by weight of the thermosetting resin composition. When the amount deviates from this range, color variation caused by the variation in film thickness is larger and no uniform hue is obtained, generally making it difficult to achieve the object of the present invention.

The hiding power of the film of the metallic coating (D) must be 50μ or more, preferably 60μ or more, more preferably 80μ or more. When the hiding power is less than 50μ, it is difficult to reflect the hue of the sublayer, i.e. the film of the light color coating (C), and the beauty, particularly the transparency of the resulting multilayer film is reduced. The hiding power of the film of the metallic coating (D) can be controlled by the metallic pigment alone, but can also be controlled by the combined use of other color pigment as necessary.

The metallic coating (D) can be obtained by mixing or dispersing the above-mentioned components with or in a solvent, for example, an organic solvent and/or water.

The metallic coating (D) is applied on the uncrosslinked and uncured film of the light color coating (C) preferably by electrostatic coating, air spraying, airless spraying or the like in a film thickness of 10–40μ, particularly 15–35μ, more particularly 20–30μ as cured. At this time, there occurs no intermixing between the uncrosslinked and uncured film of the light color coating (C) and the metallic coating (D) applied. In the present invention, the film of the metallic coating (D) is dried at room temperature or at an elevated temperature (a temperature not higher than 100° C. is preferred) without crosslinking and curing the film (the film is substantially in an uncured state), and then a clear coating (E) is applied thereon.

Clear Coating (E)

The clear coating (E) is applied on the uncured film of the metallic coating (D), is a liquid coating composition comprising a thermosetting resin composition and a solvent, and can form a transparent film.

The thermosetting resin composition includes, for example, a composition comprising a base resin such as acrylic resin, polyester resin, alkyd resin or the like, having a crosslinkable functional group (e.g. hydroxyl group) and a crosslinking agent such as amino resin (e.g. melamine resin or urea resin), polyisocyanate compound or the like. As the thermosetting resin composition, there can also be preferably used a thermosetting resin composition which need not contain, as the crosslinking agent, the above-mentioned amino resin (e.g. melamine resin or urea resin), such as described in, for example, Japanese Patent Application Kokai (Laid-Open) Nos. 84132/1987, 39653/1989 and 258526/1991, U.S. Pat. Nos. 4650718, 4703101, 4681811, 4772672, 4895910, 5026793, 5284919, 5389727 and 5274045, EP-A-353734 and 559186.

As the solvent, an organic solvent and/or water can be used. The clear coating (E) can be prepared by dissolving or dispersing the thermosetting resin composition in the solvent. The clear coating (E) can further comprise, as necessary, a color pigment, a metallic pigment, an ultraviolet absorber, etc. as long as the transparency of the film of the clear coating (E) is not impaired.

The clear coating (E) is applied on the uncured film of the metallic coating (D) preferably by electrostatic coating, air spraying, airless spraying or the like in a film thickness of 10–50μ, particularly 20–45μ, more particularly 30–45μ as cured.

In the present method for film formation, a multilayer film can be obtained by applying, on a substrate, the electrocoating (A) and the intermediate coating (B) in this order, heat-curing the resulting films of the coatings (A) and (B), applying thereon the light color coating (C), the metallic coating (D) and the clear coating (E) in this order on a wet-on-wet basis, and heating the resulting films of the coatings (C), (D) and (E) to cure the films simultaneously. The preferable temperature used for curing the films of the coatings (C), (D) and (E) simultaneously is generally 100°–180° C., particularly 120°–160° C.

The present method for film formation can provide the following effects.

(1) Since there occurs no intermixing when the metallic coating (D) is directly applied on the uncured film of the light color coating (C), part of the heating steps can be eliminated.

(2) Since the light color coating (C) shows an excellent film hiding power, the total thickness of the multilayer film formed can be made smaller.

(3) The multilayer film formed has improved properties (e.g. improved smoothness and chipping resistance).

Thus, the method for film formation according to the present invention can be favorably used for coating of automobile body, household electric appliances, etc. all made of a metal or a plastic.

The present invention is hereinafter described more concretely by way of Examples and Comparative Examples.

I. SAMPLES

(1) Cationic Electrocoating (A)

ELECRON 9400 HB (a trade name, a product of Kansai Paint Co. Ltd., an epoxy resin polyamine-blocked polyisocyanate compound type), (2) Intermediate Coating (B)

TP-37 PRIMER SURFACER (a trade name, a product of Kansai paint Co., Ltd., a polyester resin-melamine resin type, an organic solvent type).

(3) Light Color Coatings (C)

Organic solvent type coatings obtained by mixing a polyester resin, a melamine resin, a fine aluminum powder and a titanium oxide pigment in the proportions shown in Table 1. In Table 1, the amount of each component is shown in a solid content ratio.

TABLE 1

| | Light color coating (C) | | | | |
|---|---|---|---|---|---|
| | C-1 | C-2 | C-3 | C-4 | C-5 |
| Polyester resin*1 | 65 | 70 | 75 | 70 | 70 |
| Melamine resin*2 | 35 | 30 | 25 | 30 | 30 |
| Fine aluminum powder*3 | 3 | 2 | 2 | — | 2 |
| Titanium oxide pigment*4 | 120 | 100 | 80 | 80 | — |
| Iron oxide pigment*5 | 2 | 2 | 2 | 2 | 2 |
| Elongation ratio (%)*6 | 25 | 25 | 25 | 25 | 25 |
| Hiding power (μ)*7 | 11 | 13 | 15 | 50 | 100 |
| L value in Lab system | 80 | 75 | 70 | 70 | 25 |

(4) Metallic Coatings (D)

Organic solvent type coatings obtained by mixing an acrylic resin, a melamine resin and a metallic pigment in the proportions shown in Table 2. In table 2, the amount of each component is shown in a solid content ratio.

TABLE 2

| | Metallic coating (D) | | | | |
|---|---|---|---|---|---|
| | D-1 | D-2 | D-3 | D-4 | D-5 |
| Acrylic resin*8 | 65 | 70 | 75 | 70 | 70 |
| Melamine resin*9 | 35 | 30 | 25 | 30 | 30 |
| Metallic pigment | 3 | 9 | 9 | — | 40 |
| Elongation ratio (%)*6 | 4 | 6 | 8 | 6 | 2 |
| Hiding power (μ)*7 | 100< | 100< | 100< | 100< | 40 |

(*8) A methyl methacrylate type acrylic resin having a number-average molecular weight of about 2,000, a hydroxyl value of 70 and an acid value of 8.
(*9) A melamine resin, U-Van 28-60 (a product of MITSUI TOATSU CHEMCIALS, INC.)
(*10) Europearl (a product of Mearl Corp. average particle diameter = 14–18μ).

(5) Clear Coating (E)

MAGICRON CLEAR (a trade name, a product of Kansai Paint Co., Ltd., an acrylic resin-melamine resin type, an organic solvent type).

II. EXAMPLES AND COMPARATIVE EXAMPLES

The above-mentioned samples were applied and heat-cured according to the coating steps shown in Table 3, to form multilayer films. The films were tested for performances and the results are shown also in Table 3.

TABLE 3

| | | Examples | | | Comparative Examples | | | |
|---|---|---|---|---|---|---|---|---|
| | | 1 | 2 | 3 | 1 | 2 | 3 | 4 |
| Electro-coating | Symbol | (A) | | | | | | |
| | Heating conditions | 170° C. × 30 min | | | | | | |
| Inter-mediate coating | Symbol | (B) | | | | | | |
| | Heating conditions | 160° C. × 30 min | | | | | | |
| Light color coating | Symbol | C-1 | C-2 | C-3 | C-4 | C-5 | C-1 | C-2 |
| | Drying conditions | Room temp. × 5 min | | | | | | |
| Metallic coating | Symbol | D-1 | D-2 | D-3 | D-1 | D-2 | D-4 | D-5 |
| | Drying conditions | Room temp. × 5 min | | | | | | |
| Clear coating | Symbol | (E) | | | | | | |
| | Heating conditions | 140° C. × 30 min | | | | | | |
| Performance test results | | | | | | | | |
| Smoothness | | ○ | ○ | ○ | Δ | X | ○ | X |
| Chipping resistance | | ○ | ○ | ○ | ○ | ○ | ○ | Δ |
| Finish appearance | | ○ | ○ | ○ | X | X | ○ | X |
| Metallic feeling | | ○ | ○ | ○ | Δ | Δ | X | ○ |

On a degreased and zinc phosphate-treated steel plate was electrocoated, by an ordinary method, the cationic electrocoating (A) so as to give a film of 20μ in thickness as cured (hereinafter, thickness refers to thickness as cured). The coated cationic electrocoating (A) was heated at 170° C. for 30 minutes for curing. On the cured film of the cationic electrocoating (A) was coated the intermediate coating (B) so as to give a film of 30μ in thickness. The coated intermediate coating (B) was heated at 140° C. for 30 minutes for curing.

On the cured film of the intermediate coating (B) was coated one of the light color coatings (C-1) to (C-5) by the use of a minibell type rotary electrostaticcoating machine under the conditions of discharge amount=150 cc, 50,000 rpm, shaping pressure=1 kg/cm$^2$, gun distance=30 cm, booth temperature=20° C. and booth humidity=75%. The film thickness of the light color coating (C) was 10–15μ.

The resulting plate was allowed to stand in the booth for 5 minutes. Then, on the uncured film of the light color coating (C) was coated one of the metallic coatings (D-1) to (D-5) by the use of an REA gun under the conditions of discharge amount=180 cc, atomization pressure: 2.7 kg/cm$^2$, pattern pressure=3.0 kg/cm$^2$, gun distance=30 cm, booth temperature=20° C. and booth humidity=75%. The film thickness of the metallic coating (D) was 10–15μ.

The resulting plate was allowed to stand in the booth for 5 minutes. On the uncured film of the metallic coating (D) was coated the clear coating (E) by the use of a minibell type rotary electrostaticcoating machine under the conditions of discharge amount=300 cc, 40,000 rpm, shaping pressure=5 kg/cm$^2$, gun distance=30 cm, booth temperature=20° C. and booth humidity=75%. The film thickness of the clear coating (E) was 45–50μ.

The resulting plate was allowed to stand in a room for 3 minutes and then heated at 140° C. for 30 minutes in a dryer of hot air circulation type to subject the three-layered film of the light color coating (C), the metallic coating (D) and the clear coating (E) to simultaneous curing.

The performances of each resulting multilayer film was measured and rated as follows.

Smoothness

Rated visually according to the following yardstick.

○: Good

Δ: Slight surface roughening

X: Striking surface roughening

Chipping resistance

Measured using a gravelometer and 100 g of No. 7 crushed stones under the conditions of air pressure=4.5 kg/cm$^2$ and angle=45°. Rated visually according to the following yardstick.

○: Slight scar caused by impact was seen on part of the clear coating film.

Δ: Light color coating is exposed owing to the partial peeling of metallic coating film.

Finish appearance

The color development of the metallic coating (D) was examined visually and rated according to the following yardstick.

○: Color development is good.

Δ: Color development is marginally good.

X: Color development is poor.

Metallic feeling

Rated visually according to the following yardstick.

○: Metallic feeling is good owing to the uniformity of metallic coating film.

What is claimed is:

1. A method for film formation, which comprises applying onto a substrate an electrocoating (A) and an intermediate coating (B) in this order, heat-curing the formed films of the coatings (A) and (B), applying thereon a liquid light color coating (C), the light color coating (C) forming a color film having an L value of 30–95 in the Lab color system, which comprises 100 parts by weight of a thermosetting resin composition, 0.1–30 parts by weight of a fine aluminum powder having an average particle diameter of less than 10μ and 1–200 parts by weight of a titanium oxide pigment and which shows a film hiding power of 25μ or less and a film elongation ratio of 10–50% at 20° C., a liquid metallic coating (D) which comprises 100 parts by weight of a thermosetting resin composition and 0.1–20 parts by weight of a metallic pigment having an average particle diameter of 3μ or more and which shows a film hiding power of 50μ or more and a film elongation ratio of 10% or less at 20° C., and a clear coating (E) in this order on a wet-on-wet basis, and heating the formed films of the coatings (C), (D) and (E) to crosslink and cure the three films simultaneously.

2. The method according to claim 1, wherein the electrocoating (A) is a cationic electrocoating.

3. The method according to claim 1, wherein the film of the electrocoating (A) has a thickness of 10–30μ as cured.

4. The method according to claim 1, wherein the intermediate coating (B) is applied after the film of the electrocoating (A) has been crosslinked and cured.

5. The method according to claim 1, wherein the intermediate coating (B) comprises a thermosetting resin composition and a solvent.

6. The method according to claim 1, wherein the film of the intermediate coating (B) has a thickness of 10–50μ as cured.

7. The method according to claim 1, wherein the film of the light color coating (C) shows an elongation ratio of 15–40% at 20° C.

8. The method according to claim 1, wherein the fine aluminum powder in the light color coating (C) has an average particle diameter of 3–7μ.

9. The method according to claim 1, wherein the titanium oxide pigment in the light color coating (C) has an average particle diameter of 5μ or less.

10. The method according to claim 1, wherein the light color coating (C) is a liquid coating composition comprising 100 parts by weight of a thermosetting resin composition, 0.5–20 parts by weight of a fine aluminum powder having an average particle diameter of less than 10μ and 50–150 parts by weight of a titanium oxide pigment.

11. The method according to claim 1, wherein the light color coating (C) is a liquid coating composition comprising 100 parts by weight of a thermosetting resin composition, 1–7 parts by weight of a fine aluminum powder having an average particle diameter of less than 10μ and 80–120 parts by weight of a titanium oxide pigment.

12. The method according to claim 1, wherein the light color coating (C) comprises a fine aluminum powder having an average particle diameter of less than 10μ in an amount of 1–15 parts by weight per 100 parts by weight of a titanium oxide pigment.

13. The method according to claim 1, wherein the light color coating (C) comprises a fine aluminum powder having an average particle diameter of less than 10μ in an amount of 1–10 parts by weight per 100 parts by weight of a titanium oxide pigment.

14. The method according to claim 1, wherein the light color coating (C) forms a light color film having a L value of 50–80 in the Lab color system.

15. The method according to claim 1, wherein the film of the light color coating (C) has a thickness of 3–25μ as cured.

16. The method according to claim 1, wherein the metallic coating (D) shows a film elongation ratio of 8% or less at 20° C.

17. The method according to claim 1, wherein the metallic pigment in the metallic coating (D) is a pigment selected from the group consisting of aluminum, mica, mica coated with a metal oxide, micaceous iron oxide and micaceous iron oxide coated with a metal oxide.

18. The method according to claim 1, wherein the metallic pigment in the metallic coating (D) has an average particle diameter of 10–50μ.

19. The method according to claim 1, wherein the metallic pigment in the metallic coating (D) has an average particle diameter of 15–40μ.

20. The method according to claim 1, wherein the metallic coating (D) is a liquid metallic coating comprising 100 parts by weight of a thermosetting resin composition and 2–15 parts by weight of a metallic pigment.

21. The method according to claim 1, wherein the metallic coating (D) is a liquid metallic coating comprising 100 parts by weight of a thermosetting resin composition and 3–10 parts by weight of a metallic pigment.

22. The method according to claim 1, wherein the film of the metallic coating (D) has a thickness of 10–40μ as cured.

23. The method according to claim 1, wherein the film of the clear coating (E) has a thickness of 10–50μ as cured.

24. The method according to claim 1, wherein the films of the coatings (C), (D) and (E) are heated at a temperature of 100°–180° C. to crosslink and cure the films simultaneously.

25. A coated article obtained by the method of claim 1.

* * * * *